US007508290B2

(12) United States Patent
Honsberg-Riedl et al.

(10) Patent No.: US 7,508,290 B2
(45) Date of Patent: Mar. 24, 2009

(54) INDUCTIVE COMPONENT AND USE OF SAID COMPONENT

(75) Inventors: Martin Honsberg-Riedl, Teisendorf (DE); Johann Otto, Bad Tölz (DE); Eckhard Wolfgang, München (DE)

(73) Assignee: Siemens Aktiengesellschaft, Munich (DE)

( * ) Notice: Subject to any disclaimer, the term of this patent is extended or adjusted under 35 U.S.C. 154(b) by 233 days.

(21) Appl. No.: 10/521,742

(22) PCT Filed: Jul. 21, 2003

(86) PCT No.: PCT/DE03/02447

§ 371 (c)(1),
(2), (4) Date: May 10, 2005

(87) PCT Pub. No.: WO2004/017338

PCT Pub. Date: Feb. 26, 2004

(65) Prior Publication Data

US 2005/0206487 A1 Sep. 22, 2005

(30) Foreign Application Priority Data

Jul. 19, 2002 (DE) ..... 102 32 952

(51) Int. Cl.
*H01F 17/06* (2006.01)

(52) U.S. Cl. ..... 336/178; 336/179

(58) Field of Classification Search ..... 336/178
See application file for complete search history.

(56) References Cited

U.S. PATENT DOCUMENTS 1,876,451 A 9/1932 Gurtler (Continued)

FOREIGN PATENT DOCUMENTS

DE 1439441 12/1968

(Continued)

OTHER PUBLICATIONS

Patent Abstracts of Japan for Japanese Publication No. 08-111322, published Apr. 1996.

(Continued)

*Primary Examiner*—Elvin G Enad
*Assistant Examiner*—Joselito Baisa
(74) *Attorney, Agent, or Firm*—Staas & Halsey LLP

(57) ABSTRACT

An inductive component, for the formation of a magnetic circuit has at least one wire winding and at least one core with a ferromagnetic core material. The core comprises a gap and at least one further gap to interrupt the magnetic circuit. The inductive component is characterized in that the gaps each have a gap width of at least 1.0 mm. The core comprises two pieces, for example, which are arranged opposed to each other across the gaps and separated from each other by the gap width. The component is advantageously symmetrical with an essentially equal gap width for the gaps. A miniaturized inductive component is possible by the use of a hire winding made from high frequency braided wire and core material capable of accepting high frequencies, which has a high Q-factor even on a high power throughput and thus low electrical losses. In order to increase the Q-factor, the inductive component also has a cooling device for cooling the wire winding. The device is thus provided with a composite material with a thermally-conducting filler. The inductive component is used in a so-called electronic ballast (EVG) in the field of illumination.

20 Claims, 4 Drawing Sheets

U.S. PATENT DOCUMENTS

| | | | | |
|---|---|---|---|---|
| 3,617,966 | A | 11/1971 | Trench et al. | |
| 3,855,561 | A * | 12/1974 | Gottschalt | 336/83 |
| 4,546,210 | A | 10/1985 | Akiba et al. | |
| 4,885,445 | A | 12/1989 | Taniguchi | |
| 5,719,546 | A * | 2/1998 | Ito et al. | 336/180 |
| 6,259,347 | B1 | 7/2001 | Sines | |
| 6,377,775 | B1 | 4/2002 | Nakayama et al. | |
| 6,512,437 | B2 * | 1/2003 | Jin et al. | 336/178 |
| 6,593,839 | B2 * | 7/2003 | Nakayama et al. | 336/182 |

FOREIGN PATENT DOCUMENTS

| | | | |
|---|---|---|---|
| DE | 2148057 | | 6/1976 |
| DE | 3438144 | A1 | 5/1985 |
| DE | 3611069 | A1 | 10/1987 |
| DE | 3700488 | A1 | 7/1988 |
| DE | 3821284 | A1 | 12/1989 |
| DE | 4233898 | A1 | 4/1994 |
| DE | 19854902 | A1 | 2/2000 |
| DE | 19751548 | C2 | 3/2001 |
| DE | 10042283 | A1 * | 3/2002 |
| DE | 10042283 | A1 | 3/2002 |
| EP | 0193057 | A2 | 9/1986 |
| EP | 440865 | A1 * | 8/1991 |
| JP | 61167352 | A * | 7/1986 |
| JP | 61-193411 | | 8/1986 |
| JP | 8-321425 | | 12/1996 |
| JP | 2000-356919 | | 12/2000 |
| JP | 2000356919 | A * | 12/2000 |
| WO | WO91/09441 | | 6/1991 |

OTHER PUBLICATIONS

Patent Abstracts of Japan for Japanese Publication No. 01-286409, published Nov. 1989.
Patent Abstracts of Japan for Japanese Publication No. 01-243407, published Sep. 1989.
German Translation of Japanese Office Action.

* cited by examiner

INDUCTIVE COMPONENT AND USE OF SAID COMPONENT

CROSS REFERENCE TO RELATED APPLICATIONS

This application is based on and hereby claims priority to PCT Application No. PCT/DE2003/002447 filed on Jul. 21, 2003 and German Application No. 102 32 952.4 filed on Jul. 19, 2002, the contents of which are hereby incorporated by reference.

BACKGROUND OF THE INVENTION

The invention relates to an inductive component for the formation of a magnetic circuit, comprising at least one wire winding and at least one core with a ferromagnetic core material, the core comprising a gap and at least one further gap to interrupt the magnetic circuit. In addition, use of the component is specified.

An electronic ballast is used as an electronic voltage and/or current converter in the area of lighting technology. Electronic ballasts comprise at least one inductive component. The inductive component is, for example, a choke coil or a transformer. The inductive component has a wire winding. The wire winding comprises a plurality of windings of an electrical conductor to produce a magnetic flux by the current flowing in the conductor. The wire winding also serves for producing a voltage by changing the magnetic induction in the wire winding. To increase the magnetic induction and to reduce a magnetic leakage loss, the wire winding is usually located on a core with ferromagnetic material. The ferromagnetic core material is, for example, a ferrite. The core provides a magnetic circuit which is as closed as possible.

These electronic ballasts are increasingly miniaturized. The miniaturization relates in particular to an inductive component of the electronic ballasts. A small overall size of an inductive component can be achieved with the same power throughput by a higher switching frequency. However, a higher switching frequency leads to an increase in the electrical losses and consequently to a decrease in the quality of the inductive component. The quality is a measure of the electrical quality of the inductive component. With increasing miniaturization of the inductive component, it is possible as a result of the diminishing quality for an inadmissibly high operating temperature to occur, in particular when the inductive component is operated under a high AC voltage.

SUMMARY OF THE INVENTION

One possible object of the present invention is to provide an inductive component which has a high quality even when a high AC voltage is applied.

This object may be achieved by an inductive component for the formation of a magnetic circuit, comprising at least one wire winding and at least one core with a ferromagnetic core material, the core comprising a gap and at least one further gap to interrupt the magnetic circuit. The inductive component is characterized in that the gaps each have a gap width of at least 1.0 mm. This results in a relatively wide overall gap, which is divided between at least two gaps. In particular, the gap width of the gaps is respectively selected from the range from 1.2 mm to 10 mm, inclusive. The gap width is preferably 2 mm to 10 mm.

A gap is a desired interruption in the magnetic circuit. The gap width is in this case preferably approximately the same over the entire extent of the gap. The extent is, for example, a width, a length or a radius of the gap. To interrupt the magnetic circuit, the gap at least partly comprises a non-ferromagnetic material. The non-ferromagnetic material is, for example, a diamagnetic or paramagnetic material. The magnetic circuit is interrupted at least two points. The interruption is brought about by the gaps. The gap widths have the effect that the magnetic circuit is interrupted over a length of at least 2×0.5 mm. It has surprisingly been found that, in spite of using an AC voltage of several hundred volts to activate the inductive component, a relatively high quality Q can be achieved on account of these gaps. Therefore, a smaller overall size of the inductive component is possible in comparison with an inductive component with differently configured gaps.

In one particular configuration, the core comprises at least two parts which are arranged opposed to each other across the gaps and separated from each other by the gap widths.

Preferably, at least one of the gaps is an air gap. This means that the intermediate space in the core defined by the gap contains air. The non-ferromagnetic material of the gap is air. However, a different non-ferromagnetic, gaseous material may also be arranged in the air gap. On the other hand, a solid or liquid non-ferromagnetic material is also conceivable. This material is, for example, a polymer material. For example, the use of an adhesive with which the parts of the core are bonded together is advantageous. The adhesive leads not only to an interruption in the magnetic circuit. It also leads to an integral contact between the parts of the core.

In one particular configuration, the gaps have an essentially equal gap width. For example, the core comprises two parts which are separated from each other by two gaps. Gaps of equal width have the effect that the two parts are arranged in each case at the same distance from each other. Essentially equal means that small deviations of up to 10% of the gap width are also admissible.

In a further configuration, the wire winding comprises an inner region and an outer region and the gaps of the core are arranged in the inner region and/or in the outer region of the wire winding. For example, one gap is arranged in the inner region and two gaps are arranged in the outer region. The gaps in the outer region are preferably distinguished by the gap width being essentially equal. In this case, it is also possible for the gap in the inner region of the wire winding to have a much greater gap width than the two gaps in the outer region. Preferably, however, the gap widths of all the gaps are essentially equal.

The core may be unsymmetrical. This means that it cannot be transformed into itself by applying a symmetry operation. In a further configuration, the core is essentially symmetrical. Essentially means here that there may be deviations with respect to an exact symmetry. In addition, essentially means that the symmetry concerns those elements of the core that are mainly responsible for the function and properties of the core. The symmetrical core is transformed into itself by reflection at a point (center of symmetry), at a straight line (axis of symmetry) or a plane (plane of symmetry). For example, the elements of symmetry are arranged in the interior space of the wire winding. The element of symmetry is, for example, a plane of symmetry which is arranged perpendicularly in relation to a winding axis of the wire winding. The winding axis of the wire winding is given by a direction in which the wire is wound up. The core comprises, for example, two parts which are respectively transformed into each other by the reflection at the plane of symmetry. For this purpose, the plane of symmetry preferably also contains the gaps and the core comprises parts that are formed mirror-symmetrically in relation to one another. For example, the core has an RM6 or comparable core shape. These core shapes are a combination of an E core shape with a cup-type core shape.

In particular, the entire component comprising the wire winding and the core has an essentially symmetrical construction. This means that not only the core but also the wire winding are constructed in an essentially symmetrical manner. For example, the wire winding and the core can be transformed into themselves by a reflection at a common plane of reflection. Essentially symmetrical means here that deviations from symmetry are also quite conceivable. These deviations relate in particular to a number or shape of the windings of the wire winding, a shape of the core and an arrangement of the wire winding and core in relation to each other.

In particular, the core material of the core is capable of accepting high frequencies. Preferably, the core material is a ferrite in the form of an M33 core material with a cutoff frequency of approximately 10 MHz. This core material comprises manganese and zinc. Similarly, a K1, K6 or K12 core material is conceivable. These core materials comprise nickel and zinc. The K6 core material has, for example, a cutoff frequency of 7 MHz.

In one particular configuration, the wire winding comprises a high-frequency braided wire with a multiplicity of individual wires that are electrically insulated from one another. A braided wire is a wire which is wound or braided from many metal filaments (individual wires). In the case of a high-frequency braided wire, the individual wires are insulated from one another in order to reduce losses caused by the skin effect and eddy currents. As a result, a lower high-frequency loss resistance is achieved in comparison with a braided wire with individual wires of the same cross section that are not insulated from one another. In particular, the individual wires have at least an individual wire diameter that is selected from the range from 10 μm to 50 μm, inclusive. In particular, the multiplicity is selected from the range from 5 to 100, inclusive. Preferably, the multiplicity is selected from the range from 10 to 30, inclusive. For example, 10 or more individual wires are arranged to form a high-frequency braided wire. This allows wire windings with a relatively great surface area, and consequently with a relatively low high-frequency loss resistance, to be provided.

In particular, the inductive component is a choke coil or a transformer. A choke coil is permeable to DC current. On the other hand, AC current is restricted by the choke coil. The choke coil has a high electrical reactance for a current of high frequency. The transformer comprises at least two wire windings. However, more than two wire windings may also be arranged to form the transformer. As an alternative to this, the transformer comprises a wire winding which is subdivided into two parts by an electrical tap.

In order to increase further the high quality that can already be achieved by the structural measure described, the inductive component is also cooled. For this purpose, according to one particular configuration there is at least one cooling device for cooling the wire winding, which device comprises at least one composite material with at least one polymer material and at least one thermally conductive filler.

With the aid of the cooling device, the heat produced in the wire winding during the operation of the inductive component can be efficiently dissipated. The efficient dissipation of the heat brings about a relatively small temperature increase of the wire winding. The small temperature increase leads to a relatively small increase in the electrical resistance in the wire winding. This results in an increased quality of the inductive component in comparison with an uncooled wire winding.

The composite material preferably comprises an electrically insulating or electrically poorly conducting polymer material with a thermally conductive and electrically poorly conducting filler. The polymer material may comprise a natural and/or synthetic polymer. The natural polymer is, for example, unvulcanized rubber. The synthetic polymer is a plastic.

The polymer material acts here as a base material of the composite material by forming a matrix in which the filler is embedded. In this case, there may be a plurality of fillers. The filler or the fillers may be in the form of powder or fibers. A diameter of a filler particle is selected from the μm range, which ranges from 100 nm to 100 μm. A degree of filling of the filler in the polymer material is in this case preferably chosen such that a coagulation limit is exceeded. Below the coagulation limit, the probability of individual filler particles touching one another is very low. This leads to a relatively low specific thermal conductivity coefficient. If the coagulation limit is exceeded, there is a relatively great probability of the filler particles touching one another. This produces a relatively high specific thermal conductivity coefficient of the composite material.

The filler is thermally conductive and preferably also electrically insulating or electrically poorly conducting. This has the effect that the inductive component can also be operated with a relatively high operating voltage. For example, the operating voltage is up to 2000 V. The composite material also has a high dielectric strength under an operating voltage of this order of magnitude. Suitable in particular as a thermally conductive and at the same time electrically insulating or electrically poorly conducting filler is a ceramic material. A ceramic material with the properties is, for example, aluminum oxide ($Al_2O_3$).

For efficient removal of heat produced in the wire winding during the operation of the inductive component, the composite material of the cooling device is preferably directly connected to the wire winding. Heat transfer away from the wire winding takes place by heat conduction.

In one particular configuration, the cooling device comprises at least one film with the composite material which is in direct, thermally conductive contact with the wire winding. The film and the wire winding are bonded in such a way that thermal conduction can take place from the wire winding to the film. The film and the wire winding are touching each other. A film thickness of the film is, for example, 0.22 mm. Dependent on the composite material (type of polymer material, type and degree of filling of the filler, etc.), a specific thermal conductivity coefficient $\lambda$ of from 0.15 K/Wm to as much as 6.5 K/Wm can in this case be achieved. In spite of the relatively small film thickness, the dielectric strength may in this case be 1 kV to 6 kV.

In order to ensure efficient heat dissipation by the cooling device, a flexible film in particular is used with the composite material. The film is plastically and/or elastically deformable. The wire winding can be embedded in the film with something approaching a form fit. A thermal contact area between the film and the wire winding over which the heat conduction takes place is in this case particularly large.

In one particular configuration, the cooling device has at least one casting compound, which comprises at least one further composite material with at least one further polymer material and at least one further thermally conductive filler and which is in direct, thermally conductive contact with the wire winding and/or the film. The composite material and the further composite material may be the same or different. The same applies to individual components of the composite material and of the further composite material. The wire winding and/or the film are partly or completely embedded in the casting compound with the further composite material. Since the further composite material is thermally conductive and a virtually complete form fit between the casting compound and the wire winding or film is brought about by the embedding, the heat from the wire winding and the film can be dissipated very efficiently via the casting compound. The use of the casting compound additionally produces a homogeneous temperature distribution within the inductive component. The wire winding of the component is homogeneously cooled. This likewise contributes to an increased quality of the inductive component.

Both in the case of the film and in the case of the casting compound, it is possible for intermediate spaces (voids) to be present between the casting compound, the film and the wire winding, which spaces are filled with air and therefore contribute to a thermal insulation of the casting compound, the film and the wire winding from one another. Efficient dissipation of heat is not possible on account of the intermediate spaces. In one particular configuration, an intermediate space that is present between the film and the wire winding and/or between the casting compound and the wire winding therefore comprises a thermally conductive material for thermally bridging the intermediate space. The intermediate space is preferably completely filled with the thermally conductive material. This leads to improved heat dissipation away from the wire winding. A thermally conductive material, which is additionally electrically insulating, is preferably used for this purpose. The thermally conductive material is therefore selected in particular from the group comprising oil, paste, wax and/or adhesive. With these thermally conductive and at the same time electrically insulating materials it is ensured that, even when high operating voltages are used, there is a requisite dielectric strength.

The cooling device of the inductive component is configured in such a way that the heat produced in the wire winding during the operation of the inductive component can be efficiently removed to the outside. For this purpose, further transfer of the heat away from the composite material of the cooling device is provided. The further transfer of the heat takes place, for example, by convection. For this purpose, a fluid which can absorb the heat is conducted past the cooling device with the composite material. The fluid is, for example, a liquid or a gas or gas mixture.

The further transfer of the heat preferably takes place by heat conduction. In one particular configuration, in the case of the inductive component the film with the composite material and/or the casting compound with the composite material is therefore connected in a thermally conducting manner by heat conduction to a heat sink. With the aid of the heat sink, it is ensured that there is the smallest possible temperature difference between the wire winding, the cooling device and the heat sink during the operation of the inductive component. For this purpose, the heat sink is preferably configured in such a way that it can absorb a large amount of heat. The heat capacity of the heat sink is great. It is also conceivable that the heat sink provides efficient removal of the heat. The heat sink is, for example, a cooling body made of a material which is distinguished by a high thermal conductivity. To maintain the heat gradient, the cooling body may be cooled by convection.

According to a second aspect, the inductive component is used in an electronic ballast, in the case of which an electrical input power is converted into an electrical output power. The input power and the output power are normally different. In particular, the component is in this case operated with an AC voltage at a frequency from the range from 100 kHz to 200 MHz, inclusive. This frequency range is referred to as the high-frequency range.

In one particular configuration, an AC voltage of up to 2000 volts is used. It has been found that, with the aid of the gaps, a high quality can be achieved even in the case of several hundred volts with a frequency of several MHz. This has the effect that the inductive component can be miniaturized and a high power throughput can nevertheless be achieved along with a high quality and low internal losses. The inductive component can consequently be referred to as a miniaturized HF-HV (high-frequency high-voltage) component.

The inductive component may also be used in an ignition transformer for igniting a discharge lamp. For igniting the discharge lamp, the discharge lamp is activated by an electrical circuit with a high AC voltage (initial voltage). In a further configuration, a voltage pulse with an AC voltage of up to 40 kV is therefore used. The component is briefly activated with this high AC voltage within a few μm (ignition period).

These and other objects and advantages of the present invention will become more apparent and more readily appreciated from the following description of the preferred embodiments, taken in conjunction with the accompanying drawings of which:

Figure 3A:
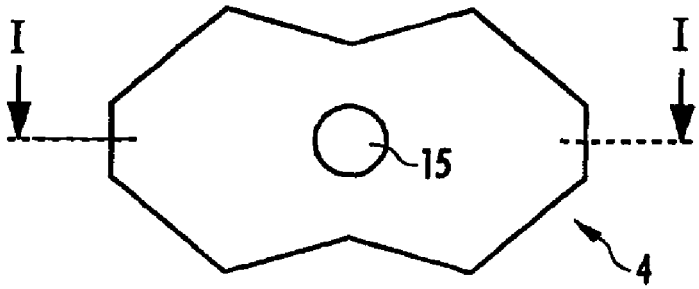
Figure 3B:
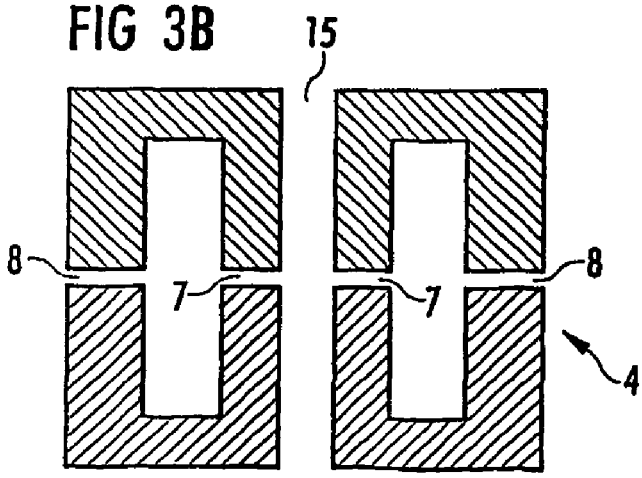

FIGS. 3*a* and 3*b* show an RM form of construction of the core of the inductive component from above and in cross section along the connecting line I-I.

Figure 1:
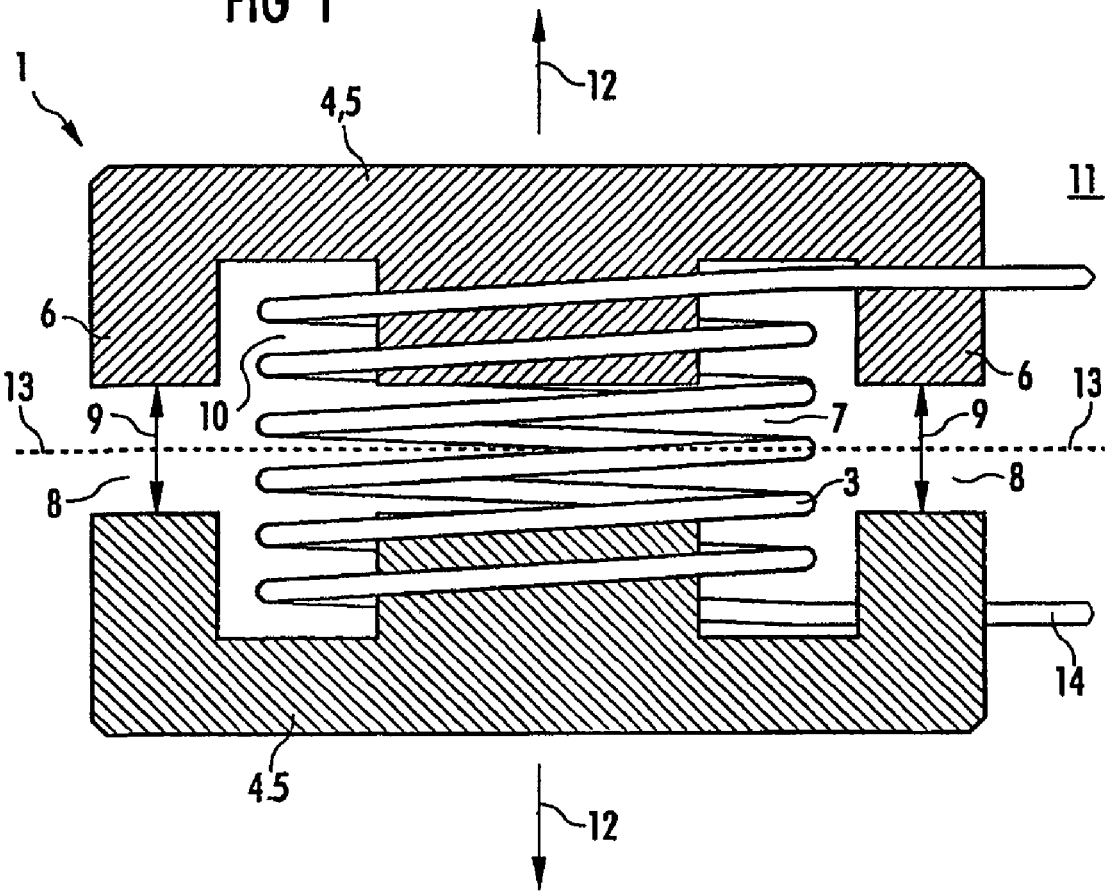
FIG. 1 shows an inductive component from the side.
Figure 4:
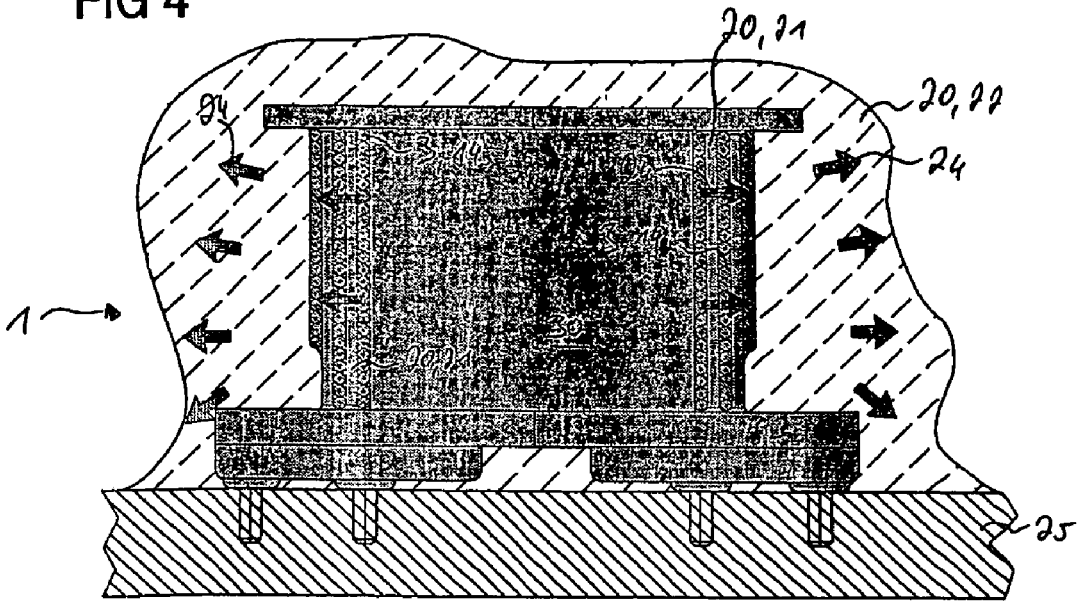
Figure 5:
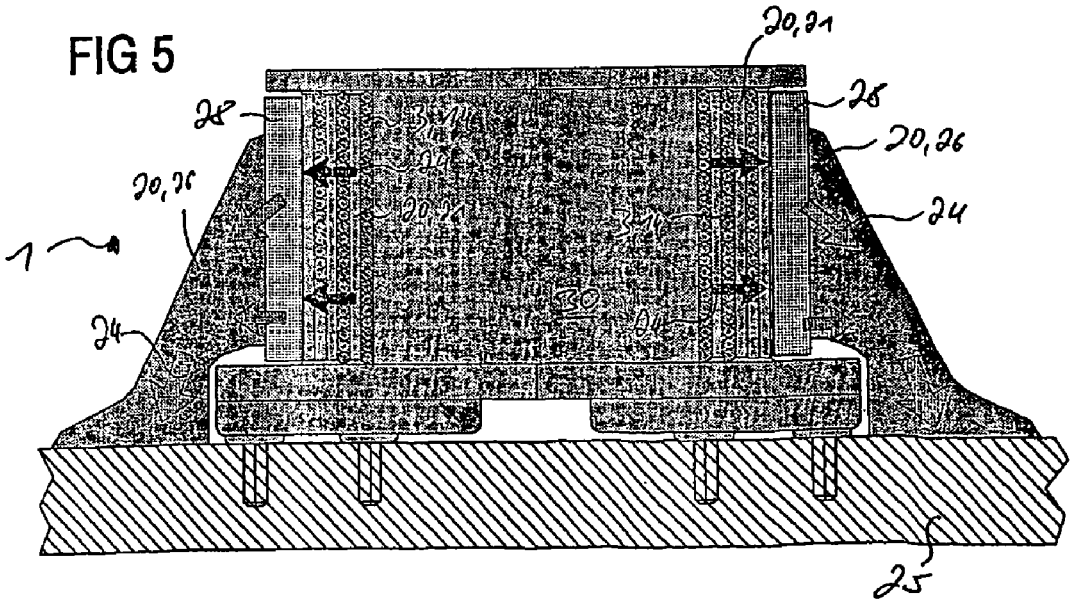
Figure 6:
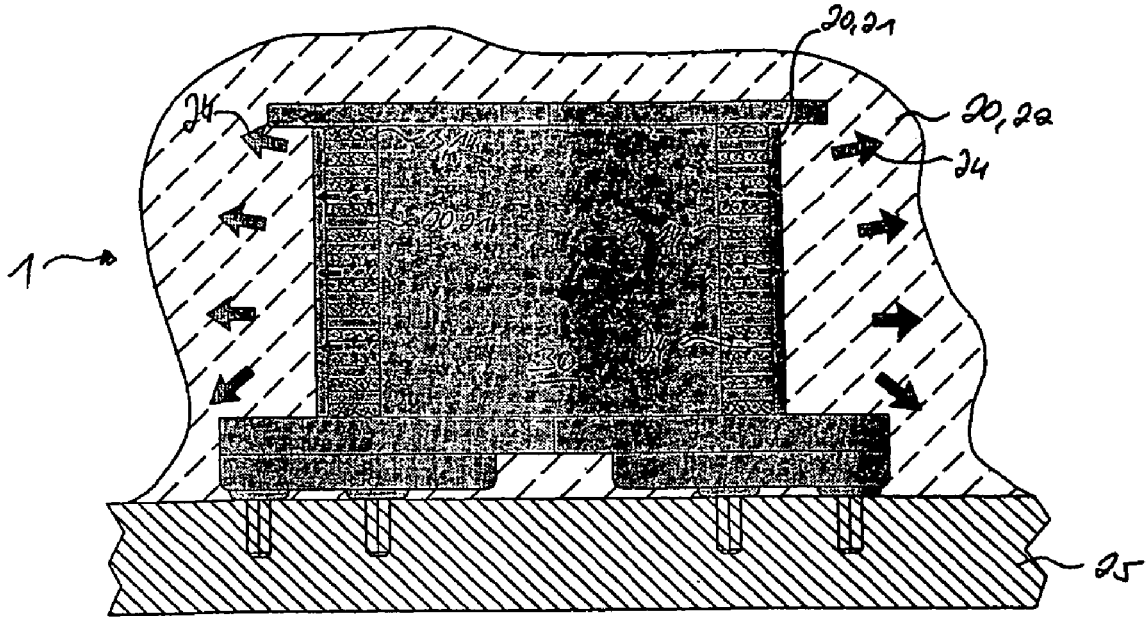

FIGS. 4 to 6 show the inductive component from FIG. 1 with a cooling device in each case, in a lateral cross section.

Figure 7:
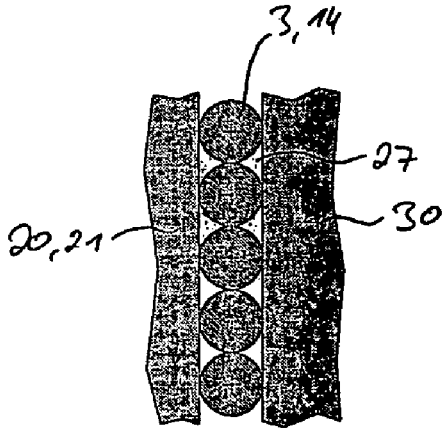

FIG. 7 shows a detail of the inductive component with the cooling device in a lateral cross section.

DETAILED DESCRIPTION OF THE PREFERRED EMBODIMENT

Reference will now be made in detail to the preferred embodiments of the present invention, examples of which are illustrated in the accompanying drawings, wherein like reference numerals refer to like elements throughout.

The inductive component 1 is an HF-HV (high-frequency high-voltage) transformer (FIG. 1). The component 1 comprises a wire winding 3 and a core 4. The wire winding is distinguished by a winding axis 12, along which the wire of the wire winding 3 is wound. The wire winding 3 is a high-frequency braided wire 14 with 30 individual wires. The wire diameter of an individual wire is approximately 30 μm. The core 4 is a ferrite core and comprises an M33 core material. The core comprises an RM6 core shape (FIGS. 3*a* and 3*b*). The core is a combination of an E core shape and a cup-type core shape with a central bore 15. The core 4 has a gap 7 in its center, which is arranged around the central bore 15 in the inner region 10 of the wire winding 3. Two further gaps 8 are arranged in the outer region 11 of the wire winding 3, in each case in one of the core limbs 6 of the core 4. All three gaps 7 and 8 are air gaps. At approximately 3 mm in each case, the gap widths of the gaps 7 and 8 are essentially equal.

The core is essentially symmetrical. It comprises two parts 5, which are arranged mirror-symmetrically in relation to the plane of reflection 13 and are arranged opposed to each other across the gaps 7 and 8 and separated from each other by the gap widths 9. The plane of reflection 13 is located in the three gaps 7 and 8. However, the arrangement has the effect that not only the core 4 but also the wire winding 3 are arranged in an essentially symmetrical manner. This results in an inductive component which is essentially symmetrical in relation to the plane of reflection 13.

Figure 2:
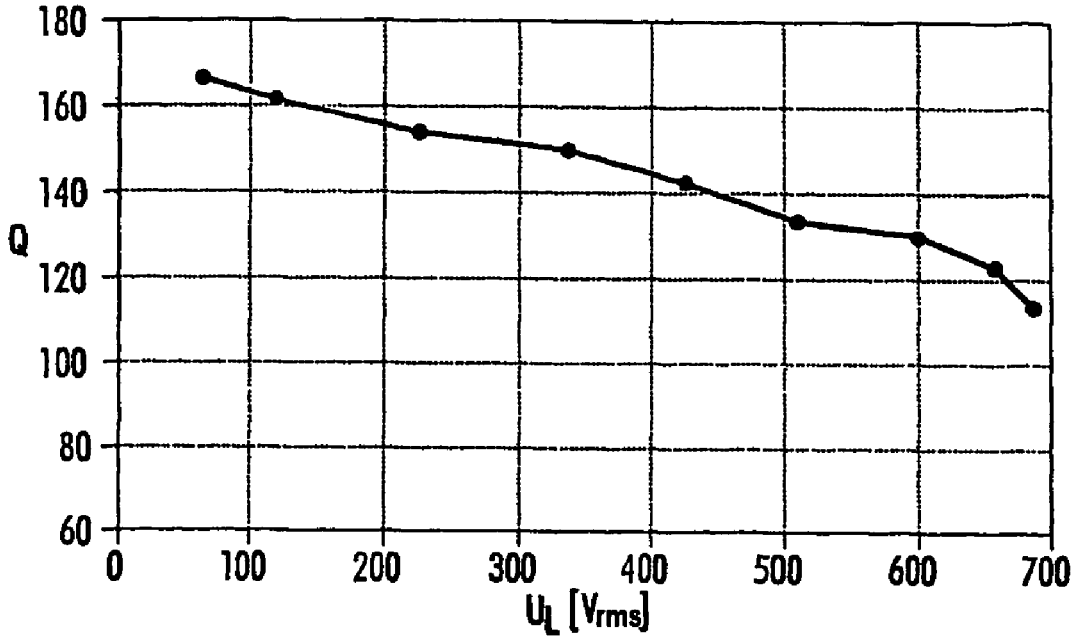
FIG. 2 shows a quality/voltage diagram of the inductive component.

The quality/voltage diagram shown in FIG. 2 was measured with a primary inductance of the HF-HV transformer 1 of 24 μH and a frequency of 2.7 MHz with the aid of the circular resonance method. It can clearly be seen that a relatively good quality of the component can be achieved even with an effective AC voltage ($U_L[V_{rms}]$) of several hundred volts. The high quality can be achieved in spite of the high frequency with a small overall size, as obtained in the case of an RM6 core shape.

The wire winding 3 of the miniaturized HF-HV transformer is cooled according to further embodiments. For this purpose, a cooling device 20 is present for cooling the wire winding 3.

According to a first embodiment, the cooling device 20 comprises a film 21 with a thermally conducting composite material. The base material of the composite material is a thermally and electrically poorly conducting polymer material. Embedded in the polymer material is a filler with a high thermal and low electrical conductivity. The film 21 has a film thickness of approximately 0.22 mm. The specific thermal conductivity coefficient λ is approximately 4 K/Wm. The dielectric strength is up to 6 kV.

The high-frequency braided wire 14 of the wire winding 3 and the film 21 are wound around a coil former 30 adapted to the RM6 core shape. In this case, the film 21 and the wire winding 3 are arranged around the coil former 30 in such a way that the high-frequency braided wire 14 of the wire winding 3 and the films 21 alternate in the radial direction, starting from the coil former 30 (FIGS. 4 and 5). The film 21 used serves as an intermediate insulating layer of the high-frequency braided wire 14 of the wire winding 3. This results in an efficient heat conducting path 24 away from the wire winding 3 in the radial direction. Heat which is produced in the high-frequency braided wire 14 during the operation of the inductive component 1 is efficiently dissipated along the heat conducting path 24.

According to an alternative embodiment, the high-frequency braided wire 14 of the wire winding 3 and a plurality of films 21 are themselves respectively aligned radially in relation to the coil former 30. This creates a multi-chamber solution, which is also referred to as a disk winding. Here, too, efficient dissipation of the heat over the heat conducting path 24 is provided.

For the further dissipation of the heat, the inductive component 1 or the cooling device 20 of the inductive component 1 is embedded in a casting compound 22 with a further thermally conductive composite material (FIGS. 4 and 6). The casting compound 22 is in direct thermally conducting contact with part of the wire winding 3. This means that the heat can be dissipated by heat conduction over a thermal contact area between the high-frequency braided wire 14 of the wire winding 3 and the film 21 or the films 21. For efficient dissipation of the heat, the casting compound 22 is connected in a thermally conducting manner to the heat sink 25 by heat conduction. The heat sink 25 is a printed circuit board with a thermally highly conductive material. This results in a relatively small temperature difference between the wire winding 3 and the heat sink 25 during the operation of the inductive component.

As an alternative to the casting compound 22, the further dissipation of the heat takes place through a dissipating fin 26 with a relatively high heat conductivity coefficient (FIG. 2). By the dissipating fin 26, which is connected to the films 21 by a spacing ceramic 28 with a relatively high heat conducting coefficient, the heat is passed on from the films 21 or the wire winding 3 in the direction of the heat sink 25.

Both in the case of the casting compound 22 and in the case of the film 21, intermediate spaces 27 may be present, reducing the efficiency with which the wire winding 3 is cooled (FIG. 7). According to a further embodiment, these intermediate spaces 27 are filled with a thermally conductive and electrically insulating or poorly conducting paste.

The invention has been described in detail with particular reference to preferred embodiments thereof and examples, but it will be understood that variations and modifications can be effected within the spirit and scope of the invention covered by the claims which may include the phrase "at least one of A, B and C" or a similar phrase as an alternative expression that means one or more of A, B and C may be used, contrary to the holding in *Superguide v. DIRECTV,* 69 USPQ2d 1865 (Fed. Cir. 2004).

The invention claimed is:

1. An inductive component for the formation of a magnetic circuit, comprising:

at least one wire winding formed of a braided wire having 5 to 100 individual wires that are electrically insulated from one another, the individual wires having an individual wire diameter within the range of from 10 μm to 50 μm;

at least one core formed of a ferromagnetic core material, the core having at least two symmetrical core parts which are opposed to each other and separated by gaps therein to interrupt the magnetic circuit, the gaps each having a gap width within the range of from 2.0 mm to 10 mm, inclusive, at least one of the gaps being an air gap, all of the gaps having an essentially equal gap width;

a heat sink; and a cooling device to cool the wire winding, the cooling device comprising:

a film formed of a first polymer-thermally conductive filler composite material, the film being in thermally conductive contact with the wire winding; and a casting compound formed of a second polymer-thermally conductive filler composite material different form the first polymer-thermally conductive filler composite material, the casting compound being in thermally conductive contact with the heat sink.

2. An inductive component for the formation of a magnetic circuit, comprising:

at least one wire winding;

at least one core formed of a ferromagnetic core material, the core having space gaps therein to interrupt the magnetic circuit, each space gap that interrupts the magnetic circuit having a gap width within the range of from 2.0 mm to 10 mm, inclusive; and a cooling device to cool the wire winding, the cooling device having a first portion formed from a first composite material and a second portion formed from a casting compound, which comprises a second composite material different from the first composite material, both the first and second composite materials being formed from a polymer material and a thermally conductive filler, the second portion being in direct, thermally conductive contact with the wire winding and/or the first portion.

3. The component as claimed in claim 2, wherein the core comprises at least two core parts which are opposed to each other across the gaps and are separated from each other by the gap widths.

4. The component as claimed in claim 2, wherein at least one of the gaps is an air gap.

5. The component as claimed in claim 2, wherein the gaps all have an essentially equal gap width.

6. The component as claimed in claim 2, wherein the wire winding defines an inner region and an outer region, and the gaps of the core are positioned in the inner region and/or in the outer region.

7. The component as claimed in claim 2, wherein the core is essentially symmetrical.

8. The component as claimed in claim 2, wherein the core is formed of a material that can withstand high frequencies.

9. The component as claimed in claim 2, wherein the wire winding comprises a high-frequency braided wire having a multiplicity of individual wires that are electrically insulated from one another.

10. The component as claimed in claim 9, wherein the individual wires have an individual wire diameter that is selected from the range of from 10 μm to 50 μm, inclusive.

11. The component as claimed in 9, wherein the wire winding is formed from 5 to 100 individual wires.

12. The component as claimed in claim 2, wherein the component is a choke coil or a transformer.

13. The component as claimed in claim 2, wherein the cooling device comprises at least one film formed of the composite material which film is in direct, thermally conductive contact with the wire winding.

14. The component as claimed in claim 2, wherein an intermediate space is present between the cooling device and the wire winding, the intermediate space being filed with a thermally conductive material.

15. The component as claimed in claim 14, wherein the thermally conductive material is at least one of an oil, a paste, a wax and/or an adhesive.

16. The component as claimed in claim 2, further comprising a heat sink connected in a thermally conducting manner to the cooling device.

17. A method comprising:

using an inductive component as an electronic ballast, to convert an electrical input power into an electrical output power, the inductive component forming a magnetic circuit and comprising:

at least one wire winding;

at least one core formed of a ferromagnetic core material, the core having space gaps therein to interrupt the magnetic circuit, each space gap that interrupts the magnetic circuit having a gap width within the range of from 2.0 mm to 10 mm, inclusive; and a cooling device to cool the wire winding, the cooling device having a first portion formed from a first composite material and a second portion formed from a casting compound, which comprises a second composite material different from the first composite material, both the first and second composite materials being formed from a polymer material and a thermally conductive filler, the second portion being in direct, thermally conductive contact with the wire winding and/or the first portion.

18. The use as claimed in claim 17, wherein the inductive component is operated with an AC voltage at a frequency of from 100 kHz to 200 MHz, inclusive.

19. The use as claimed in claim 17, wherein the inductive component is operated at an AC voltage of up to 2000 V.

20. The use as claimed in claim 17, wherein the inductive component is operated using a voltage pulse with an AC voltage of up to 40 kV.

* * * * *